US006547679B2

(12) United States Patent
Shimosaka et al.

(10) Patent No.: US 6,547,679 B2
(45) Date of Patent: Apr. 15, 2003

(54) GOLF BALL

(75) Inventors: Hirotaka Shimosaka, Chichibu (JP); Atsuki Kasashima, Chichibu (JP); Hideo Watanabe, Chichibu (JP); Junji Umezawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/172,988

(22) Filed: Jun. 18, 2002

(65) Prior Publication Data

US 2003/0036445 A1 Feb. 20, 2003

(30) Foreign Application Priority Data

Jun. 22, 2001 (JP) ..... 2001-189424

(51) Int. Cl.[7] ..... A63B 37/12
(52) U.S. Cl. ..... 473/383
(58) Field of Search ..... 473/351, 377, 473/378–385

(56) References Cited

U.S. PATENT DOCUMENTS 5,158,300 A * 10/1992 Aoyama ..... 473/384
5,846,141 A * 12/1998 Morgan et al. ..... 473/377
5,885,172 A * 3/1999 Hebert et al. ..... 473/354
6,123,630 A * 9/2000 Hayashi et al. ..... 366/128
6,213,898 B1 * 4/2001 Ogg ..... 473/383
6,331,150 B1 * 12/2001 Ogg ..... 473/383

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

In a dimpled golf ball, those dimples in which a tangent A to the dimple wall has an inclination angle of at least 13° are included in the majority, the variation of the dimple area with different positions on the ball surface and the variation of the dimple cavity volume with different positions on the ball surface are within specific ranges. The golf ball exhibits uniform flight performance in that the variation of flight performance with a dimple arrangement is minimized.

8 Claims, 8 Drawing Sheets

GOLF BALL

This invention relates to a multi-piece golf ball comprising an elastic solid core and a resin cover of at least two different hardness layers and exhibiting uniform flight performance.

BACKGROUND OF THE INVENTION

Known golf balls are generally classified into wound golf balls in which a center is wound with rubber thread and further enclosed with a balata or resin cover, and solid golf balls which, in turn, include one-piece golf balls in the form of a single elastic sphere made entirely of rubber or the like, and multi-piece golf balls in which an elastic core is enclosed with a resin cover consisting of plural layers having different physical properties. These golf balls are provided on the surface with a plurality of dimples for imparting desirable flight characteristics.

The arrangement of dimples on the ball surface is generally determined independent of the ball construction. In the traditional technology employed in the art for arranging dimples uniformly on the entire ball surface and in a high density, the ball's spherical surface is assumed to be a polyhedral body such as an octahedral, dodecahedral or icosahedral body presenting a corresponding number of polygons, circular-in-plane dimples of two to four types which typically differ in diameter are arranged in each of the polygons, and this grouping of dimples as a unit is distributed over the entire ball surface.

This technology, however, suffers from several problems. In the octahedral or icosahedral arrangement, for example, dimples are arranged in a unit triangle. Due to the technical or economical limitations associated with the manufacture of ball molds, the arrangement of dimples on the sides of a triangle must be avoided. As a result, dimples are arranged only inside the triangle. Sometimes the arrangement density of dimples lacks uniformity between a portion adjacent the side and a central portion of the triangle. Alternatively, the arrangement of dimples at the parting plane of the mold must be avoided. When dimples are distributed over the entire spherical surface using such unit triangles, the resulting arrangement of dimples apparently looks uniform. However, a precise observation revealed that the planar and steric densities of dimple arrangement had fairly large variations.

When the golfer hits a ball with a club, any position on the ball spherical surface has a substantially equal chance of impact. Due to the lack of uniformity of dimple arrangement, there is a possibility that a portion of the ball surface where dimples are distributed in a relatively high or low density be hit with the club or contacted with the club face. As far as the inventor's precise examination is concerned, the influence of dimples on the club face upon impact (revealing itself as a deviation of the ball in flight) contains a component in the lateral or vertical direction, which is not negligible. Additionally, the dimples also affect the feel and initial velocity of the ball. In golf balls having a cover of two or more layers wherein the surface hardness of the cover outermost layer is lower than the surface hardness of a cover inner layer next to the cover outermost layer, there is a tendency that dimples affect the launch angle, initial velocity and spin of the ball. Among others, a deviation of the launch angle in the lateral direction is likely to affect the ball flight to induce variations. When golf balls bear many dimples having an acute edge angle, such dimples have a more influence.

SUMMARY OF THE INVENTION

An object of the invention is to solve the above-discussed problems and to provide a multi-piece solid golf all having uniform flight performance.

The present invention provides a golf ball comprising an elastic core and a resin cover bearing a plurality of dimples and including a cover outer layer having a surface Shore D hardness of at least 50 and a cover inner layer disposed inside the cover outer layer and having a higher surface Shore D hardness than the cover outer layer. The cover defines a ball circumference and an extension thereof, and a phantom ball is given on the assumption that the ball is free of dimples. Provided that a phantom circumference is radially inwardly spaced 0.08 mm from the ball circumference, and as viewed in a radial cross section of a dimple, a tangent A is drawn to the dimple wall at an intersection of the dimple wall surface with the phantom circumference, the edge of the dimple is given by the intersection between the tangent A and the ball circumference or the extension thereof, and a tangent B is drawn to the ball circumference or the extension thereof at the dimple edge, those dimples in which the angle of inclination of the tangent A relative to the tangent B is at least 13° account for at least 50% of the entire dimples. Provided that SR is the ratio of the total area of dimples to the entire surface area of the phantom ball, a dimple-free circle having a diameter of 20 mm is drawn on an arbitrary portion of the ball surface, and sr is the ratio of the total area of those dimples residing in the circle to the area of the circle, a ratio sr/SR has a variation in the range of 0.93 to 1.07 depending on the difference of position on the ball surface. Provided that each dimple defines a cavity between the dimple wall surface and the extension of the ball circumference extending over the portion circumscribed by the dimple edge, CV is the ratio of the total cavity volume of the dimples over the entire ball to the volume of the phantom ball, and cv is the ratio of the total cavity volume of those dimples residing in the 20-mm diameter circle to the volume of a dimple-free cone diverging radially outward from the ball center to the 20-mm diameter circle, a ratio cv/CV has a variation in the range of 0.95 to 1.05 depending on the difference of position on the ball surface.

Preferably, when the 20-mm diameter circle drawn on an arbitrary portion of the ball surface is bisected into two semicircles, the difference between the total cavity volume of those dimples residing in one semicircle and the total cavity volume of those dimples residing in the other semicircle is up to 0.88 $mm^3$. Typically, the cover outer layer has a thickness of 0.8 to 2.0 mm, and the cover inner layer has a thickness of 1.0 to 2.0 mm. Most often, the cover outer layer is formed mainly of a thermoplastic or thermosetting polyurethane elastomer, and the cover inner layer is formed mainly of an ionomer resin.

In a preferred embodiment, the cover outer layer has a surface Shore D hardness of at least 52 and the cover inner layer has a surface Shore D hardness of at least 62 and higher than the cover outer layer. The cover defines a ball circumference or an extension thereof, and a phantom ball is given on the assumption that the ball is free of dimples. Provided that a phantom circumference is radially inwardly spaced 0.08 mm from the ball circumference, and as viewed in a radial cross section of a dimple, a tangent A is drawn to the dimple wall at an intersection of the dimple wall surface with the phantom circumference, the edge of the dimple is given by the intersection between the tangent A and the ball circumference or the extension thereof, and a tangent B is drawn to the ball circumference or the extension thereof at the dimple edge, those dimples in which the angle of inclination of the tangent A relative to the tangent B is at least 13° account for at least 50% of the entire dimples. Provided that SR is the ratio of the total area of dimples to the entire surface area of the phantom ball, a dimple-free circle having a diameter of 18 mm is drawn on an arbitrary portion of the ball surface, and sr' is the ratio of the total area of those dimples residing in the circle to the area of the circle, a ratio sr'/SR has a variation in the range of 0.93 to 1.07 depending on the difference of position on the ball surface. Provided that each dimple defines a cavity between the dimple wall surface and the extension of the ball circumference extending over the portion circumscribed by the dimple edge, CV is the ratio of the total cavity volume of the dimples over the entire ball to the volume of the phantom ball, and cv' is the ratio of the total cavity volume of those dimples residing in the 18-mm diameter circle to the volume of a dimple-free cone diverging radially outward from the ball center to the 18-mm diameter circle, a ratio cv'/CV has a variation in the range of 0.95 to 1.05 depending on the difference of position on the ball surface.

In a further preferred embodiment, when the 18-mm diameter circle drawn on an arbitrary portion of the ball surface is bisected into two semicircles, the difference between the total cavity volume of those dimples residing in one semicircle and the total cavity volume of those dimples residing in the other semicircle is up to 0.88 $mm^3$.

DESCRIPTION OF THE PREFERRED EMBODIMENTS

Figure 1:
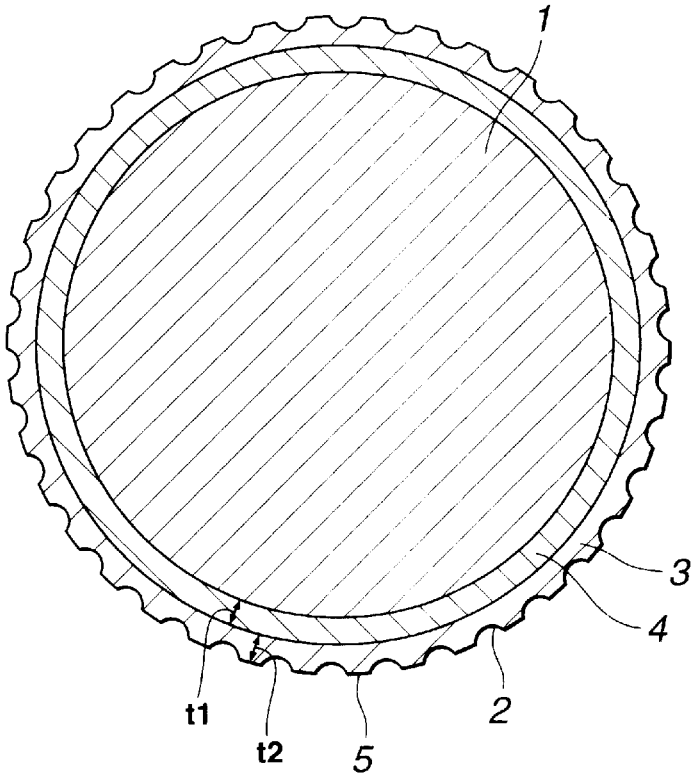
FIG. 1 is a cross-sectional view of a golf ball according to the invention.

Referring to FIG. 1, the golf ball of the invention is illustrated as a multi-piece solid golf ball comprising an elastic solid core 1 and a resin cover enclosing the core 1 and bearing a plurality of dimples 2 on its surface. The resin cover includes a cover outer layer 3 having a surface Shore D hardness of at least 50 and a cover inner layer 4 disposed inside the cover outer layer 3 and having a higher surface Shore D hardness than the cover outer layer 3. Throughout the specification, the term "radial" is used to show a radial direction about the center of the ball (see FIG. 4).

The elastic solid core may be formed of any well-known material, preferably a rubber composition. The preferred rubber composition is based on polybutadiene. The polybutadiene used herein is preferably cis-1,4-polybutadiene containing at least 40% by weight of cis structure. In the base rubber, natural rubber, polyisoprene rubber, styrene-butadiene rubber or the like may be compounded with the polybutadiene if desired. Increasing the rubber component can improve the rebound energy of the golf ball.

The elastic solid core can be prepared by vulcanizing and curing the rubber composition in a well-known manner. It is recommended that the elastic solid core have a diameter of at least 35.6 mm, preferably at least 36 mm, more preferably at least 36.2 mm, and up to 39 mm, preferably up to 38 mm, more preferably up to 37 mm, because better flight performance is expected in this diameter range.

It is recommended that the elastic solid core have a JIS-C hardness at its center of at least 55, more preferably at least 59, even more preferably at least 61 and up to 67, more preferably up to 66, even more preferably up to 65. It is also recommended that the elastic solid core have a JIS-C hardness at its surface of at least 65, more preferably at least 67, even more preferably at least 69 and up to 80, more preferably up to 78, even more preferably up to 76. If the core's hardness is outside the upper and lower limits, the desired flight performance may be lost or the feel may become too hard. The radial hardness distribution of the core is preferably such that the hardness progressively increases from the center to the surface of the core. However, a hardness distribution which is substantially flat in the radial direction is acceptable as long as the objects of the invention is not compromised.

The cover inner layer may be formed of any well-known material, preferably an ionomer resin composition.

It is recommended that the cover inner layer have a thickness t1 of at least 1.0 mm and up to 2.0 mm. Desirably, the thickness of the cover inner layer is equal to or slightly greater than the thickness of the cover outer layer.

It is recommended that the cover inner layer have a surface Shore D hardness of at least 60, more preferably at least 62 and up to 68, more preferably up to 66. As used herein, the term "surface hardness" refers to a hardness measured at the surface of a sphere. If the cover inner layer is too soft, the ball may receive a more spin rate on every shot, travel short, and give a feel too soft. If the cover inner layer is too hard, the ball may give undesired effects such as a less spin rate, less controllability, a hard feel, and poor durability against cracks after repeated impacts.

The cover outer layer may be formed of any well-known material, preferably compositions based on thermoplastic resins, thermosetting resins or the like. Thermoplastic or thermosetting polyurethane elastomers are typically used.

It is recommended that the cover outer layer have a thickness t2 of at least 0.8 mm and up to 2.0 mm. As viewed in FIG. 1, the thickness of the cover outer layer 3 is a radial distance from the surface of the cover inner layer 4 to the surface of the cover where the dimples 2 are not formed, that is, the land 5.

It is recommended that the cover outer layer have a surface Shore D hardness of at least 50, more preferably at least 52 and up to 56, which is lower than the Shore D hardness of the cover inner layer. If the cover outer layer is too soft, the ball may receive a more spin rate on every shot, travel short, and give a feel too soft. If the cover outer layer is too hard, the ball may give undesired effects such as a less spin rate, less controllability, a hard feel, and poor durability against cracks after repeated impacts.

According to the invention, the surface hardness of the cover outer layer is lower than that of the cover inner layer. It is recommended that the difference in Shore D hardness between the cover inner layer and the cover outer layer be 7 to 14 Shore D hardness units. Too small a difference may lead to insufficient spin upon iron and approach shots whereas too large a difference may detract from durability.

According to the invention, the dimples formed on the ball surface include dimples of plural types, preferably 4 to 8 types, which differ in diameter and/or depth. The dimples are circular as viewed in a plan view (perpendicular to a radial direction from the ball center). The total number of dimples is suitably chosen, preferably in the range of 360 to 520, and more preferably 400 to 452.

Figure 2:
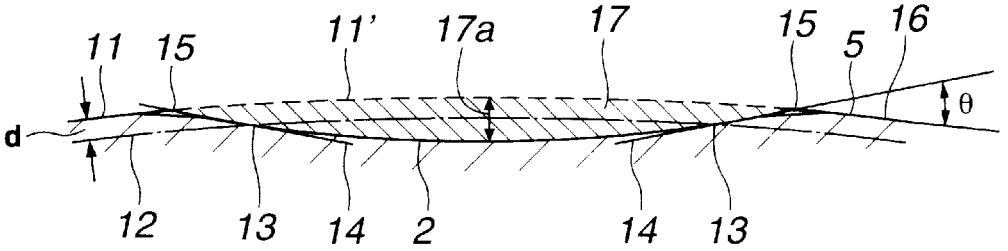
FIG. 2 is an enlarged cross-sectional view of a dimple.

Referring to FIG. 2, a dimple 2 is illustrated in a radial cross-sectional view. The cover or ball defines a ball circumference 11 (given by the series of lands 5 as seen from FIG. 1) and an arcuate extension 11' thereof that extends over the dimple (or the portion circumscribed by the dimple edge to be defined later). A phantom ball is given on the assumption that the ball is free of dimples.

As viewed in the cross section of a dimple, a phantom circumference 12 is drawn at a distance d of 0.08 mm radially inward of the ball circumference 11. A tangent (A) 14 is drawn to the dimple wall at an intersection 13 of the dimple wall surface with the phantom circumference 12. The edge 15 of the dimple is given by the intersection between the tangent 14 and the ball circumference 11 or the extension 11' thereof. In the embodiment of FIG. 2, the dimple edge 15 is on the extension 11' of the ball circumference. A tangent (B) 16 is drawn to the ball circumference 11 or the extension 11' thereof at the dimple edge 15.

According to the invention, those dimples in which the angle θ included between the tangent (A) 14 at the intersection 13 and the tangent (B) 16 at the dimple edge 15 is at least 13°, preferably 13° to 16°, more preferably 13° to 14.5°, even more preferably 13.1° to 13.8°, account for at least 50%, especially at least 70% of the total number of dimples. If those dimples in which the angle θ, that is, the angle of inclination of the tangent A relative to the tangent B is less than 13° account for at least 50% of the entire dimples, the dimples as a whole tend to perform less desirably, leading to the disadvantage of shorter distance.

Figure 3:
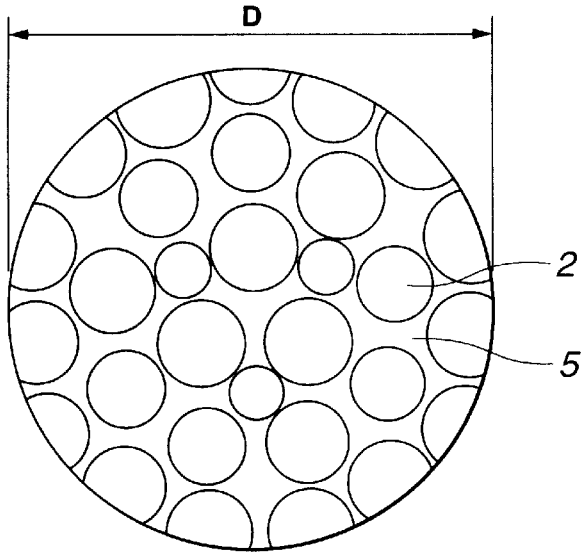
FIG. 3 is an enlarged plan view of a portion of the dimpled surface of the golf ball.

The area of each dimple 2 is defined as the area of a circle defined by the dimple edge. Each dimple 2 defines a cavity 17 between the dimple wall surface and the extension 11' of the ball circumference 11 extending over the portion circumscribed by the dimple edge 15 (depicted as a left/downward hatched region 17 in FIG. 2). The cavity 17 has a depth 17*a* which is defined as the maximum distance of the cavity in the radial direction. It is provided that SR is the ratio of the total area of dimples to the entire surface area of the phantom (dimple-free) ball. As shown in FIG. 3, a dimple-free circle having a diameter D of 20 mm is drawn on an arbitrary portion of the ball surface (the dimple-free circle means that the circle is drawn independently of the dimples), and sr is the ratio of the total area of those dimples 2 residing in the 20-mm diameter circle to the (spherical) area of the 20-mm diameter circle. According to the invention, the ratio of these ratios, sr/SR, has a variation in the range of 0.93 to 1.07 depending on the difference of position on the ball surface.

It is further provided that CV is the ratio of the total cavity volume of the dimples over the entire ball to the volume of the phantom ball, and cv is the ratio of the total cavity volume of those dimples residing in the 20-mm diameter circle to the volume of a dimple-free cone diverging radially outward from the ball center to the 20-mm diameter circle. According to the invention, the ratio of these ratios, cv/CV, has a variation in the range of 0.95 to 1.05 depending on the difference of position on the ball surface.

In a preferred embodiment, provided that SR is the ratio of the total area of dimples to the entire surface area of the phantom ball, a dimple-free circle having a diameter of 18 mm is drawn on an arbitrary portion of the ball surface, and sr' is the ratio of the total area of those dimples residing in the 18-mm diameter circle to the area of the 18-mm diameter circle, then a ratio sr'/SR has a variation in the range of 0.93 to 1.07 depending on the difference of position on the ball surface; and provided that CV is the ratio of the total cavity volume of the dimples over the entire ball to the volume of the phantom ball, and cv' is the ratio of the total cavity volume of those dimples residing in the 18-mm diameter circle to the volume of a dimple-free cone diverging radially outward from the ball center to the 18-mm diameter circle, then a ratio cv'/CV has a variation in the range of 0.95 to 1.05 depending on the difference of position on the ball surface.

Figure 4:
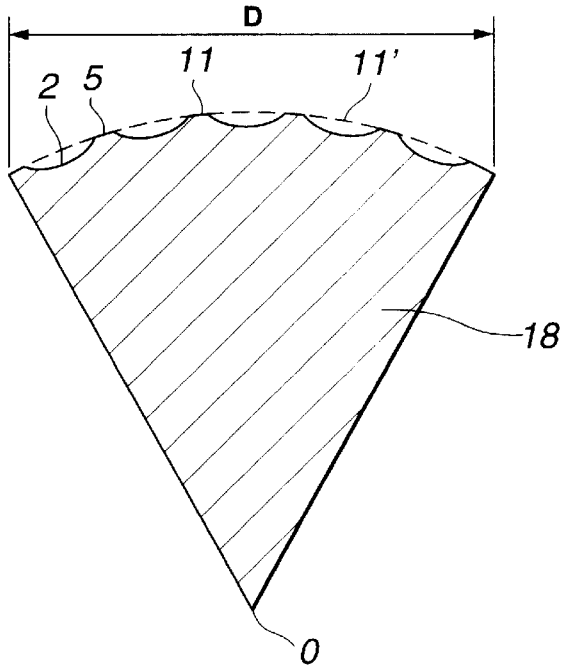
FIG. 4 is a cross-sectional view of a portion of the golf ball.

It is noted that when the circle having a diameter D of 20 mm or 18 mm is drawn on an arbitrary portion of the ball surface, the diameter D is that of a circle projected on the ball surface as shown in FIG. 4 rather than a circle having a diameter of 20 mm or 18 mm as measured along the spherical surface of the ball. Also shown in FIG. 4 is a cone 18 diverging radially outward from the ball center O to the circle having a diameter D and having a bottom delimited by the ball circumference 11 or its extension 11'.

In a more preferred embodiment, when the circle with a diameter D of 20 mm, preferably 18 mm drawn on an arbitrary portion of the ball surface is bisected into two semicircles, the difference between the total cavity volume of those dimples residing in one semicircle and the total cavity volume of those dimples residing in the other semicircle is up to 0.88 $mm^3$, and especially up to 0.86 $mm^3$.

If the variation with position of sr/SR or sr'/SR is smaller than the above-specified range, on small deformation impacts as produced with the putter or sand wedge, a hard feel or too much rebound may occur at certain positions of impact on the ball. If the same variation is larger than the above-specified range, on such small deformation impacts, too soft a feel or too less rebound may occur at certain positions of impact on the ball. If the variation with position of cv/CV or cv'/CV is smaller than the above-specified range, on large deformation impacts as produced with the driver, a hard feel or too much rebound may occur at certain positions of impact on the ball. If the same variation is larger than the above-specified range, on such large deformation impacts, too soft a feel or too less rebound may occur at certain positions of impact on the ball. If the difference in the total cavity volume of dimples between the bisections of the diameter D circle is too large, then there may occur larger variations of launch angle and spin so that the ball will be undesirably launched to left or right with respect to the target direction depending on the position of impact on the ball.

EXAMPLE

Examples of the invention are given below by way of illustration and not by way of limitation.

Examples and Comparative Examples

The test balls used in both Examples and Comparative Examples were of the three-piece structure in which a rubber core is enclosed with a cover inner layer of thermoplastic ionomer resin and a cover outer layer of thermoplastic urethane resin. The surface Shore D hardnesses of the cover inner and outer layers were changed as shown in Table 4.

Figure 5:
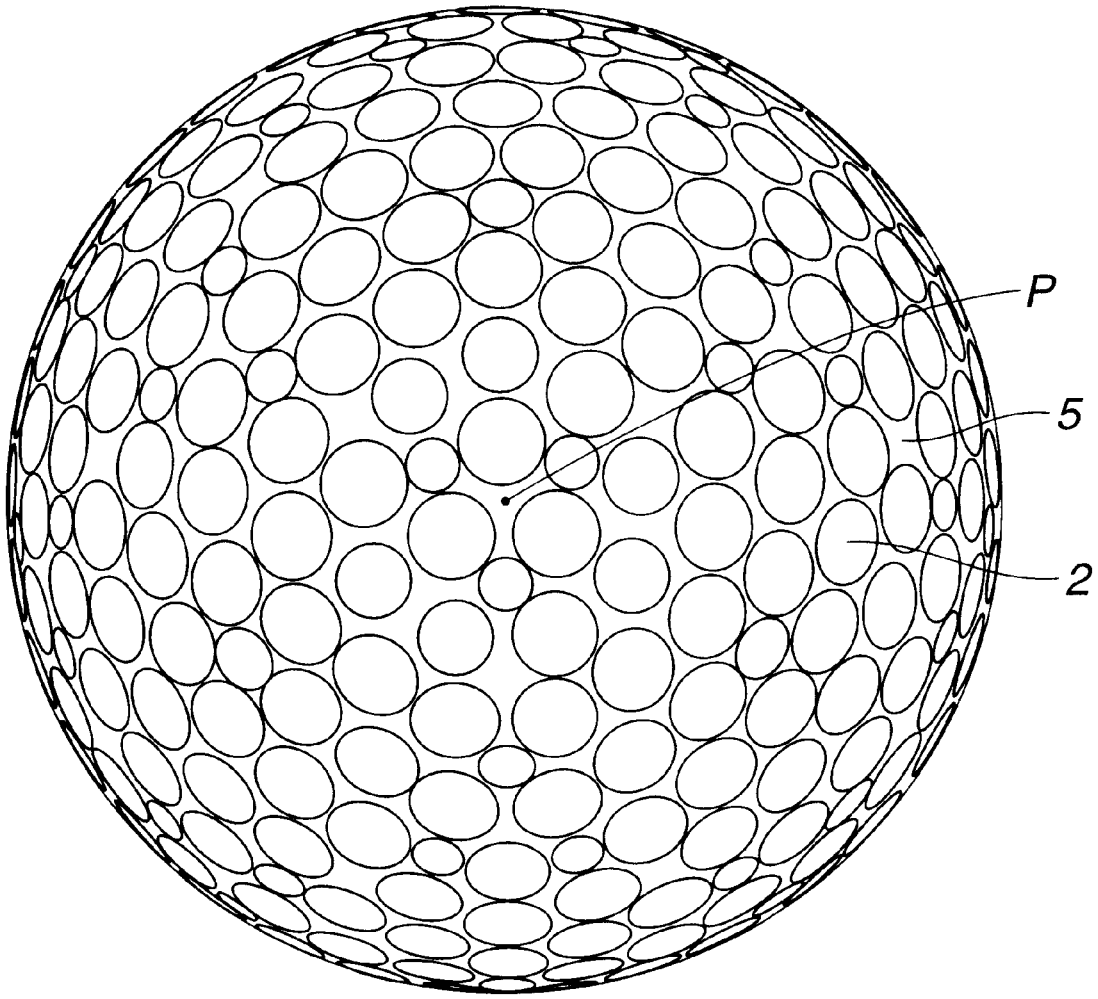
FIGS. 5 and 6 are plan and side views of one exemplary golf ball.
Figure 6:
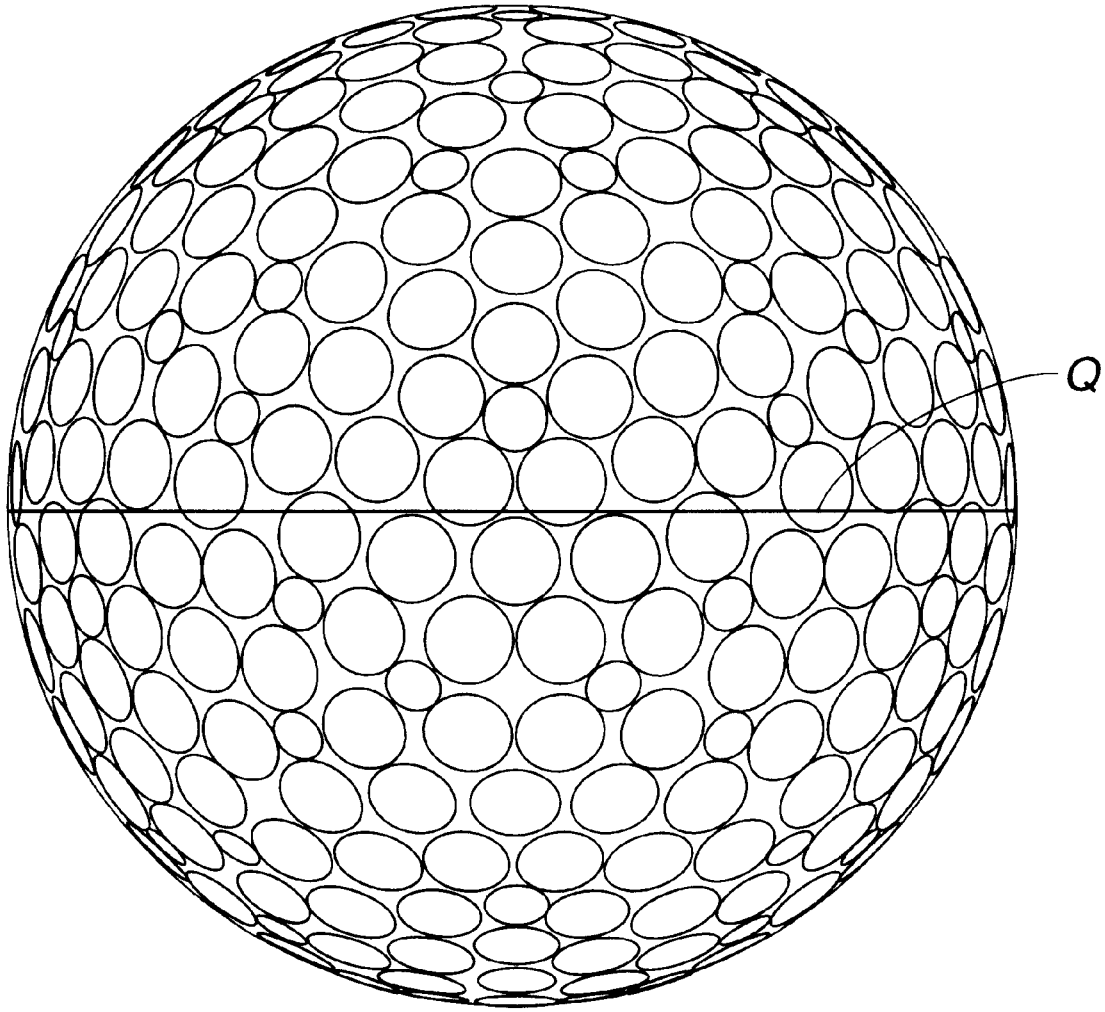
Figure 7:
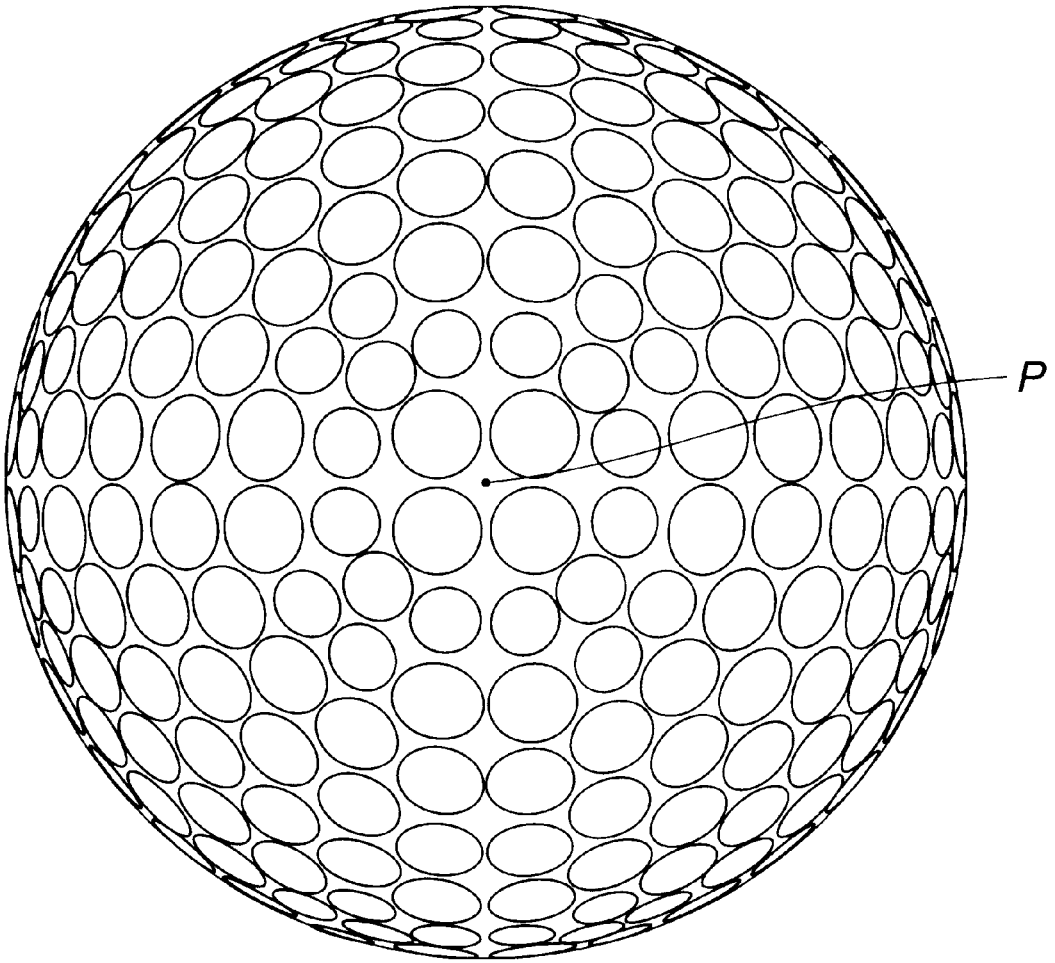
FIGS. 7 and 8 are plan and side views of another exemplary golf ball.
Figure 8:
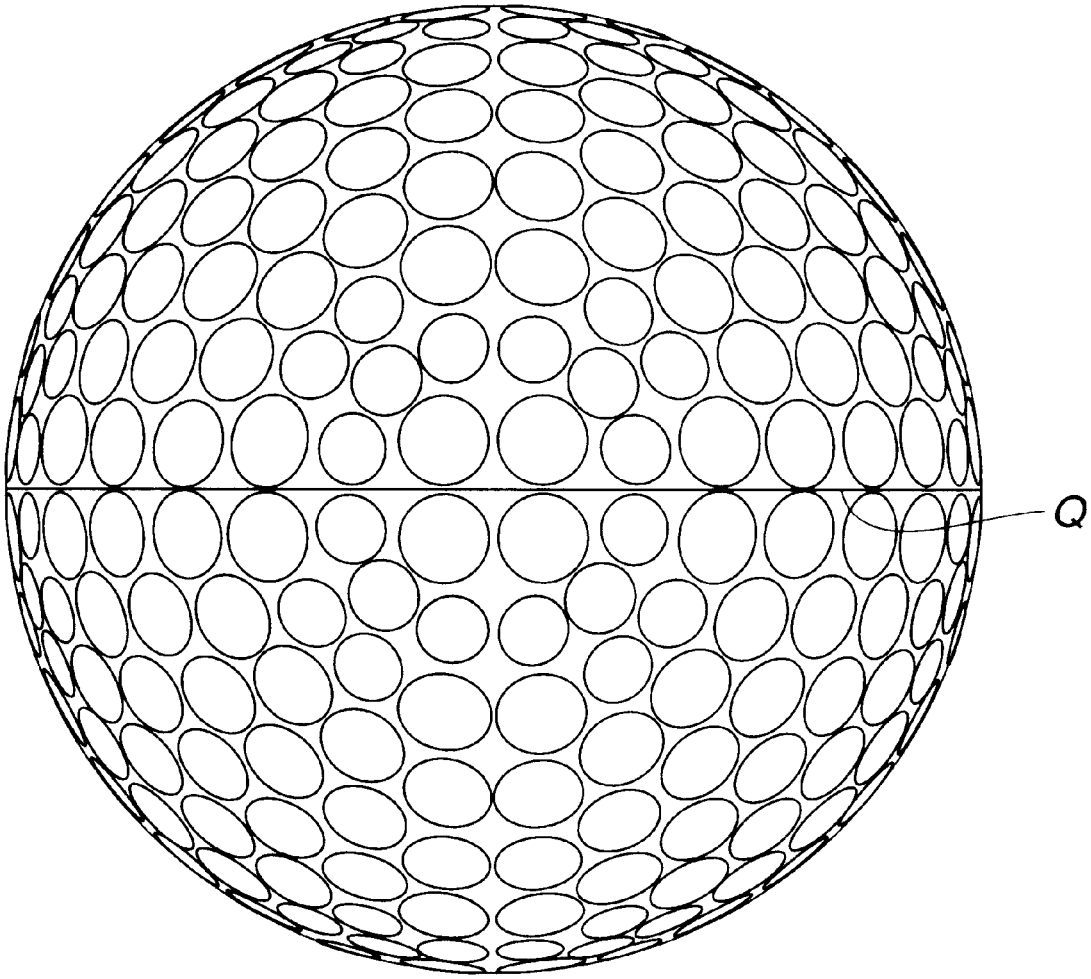
Figure 9:
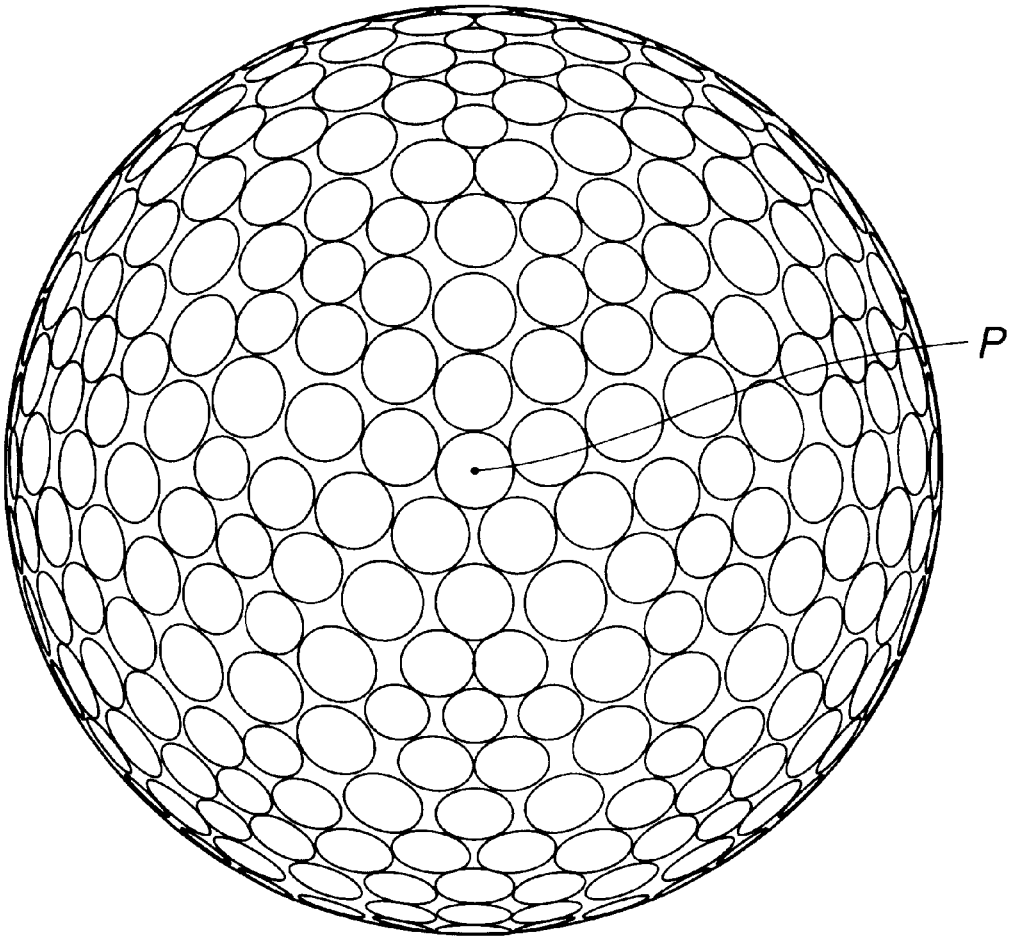
FIGS. 9 and 10 are plan and side views of a further exemplary golf ball.
Figure 10:
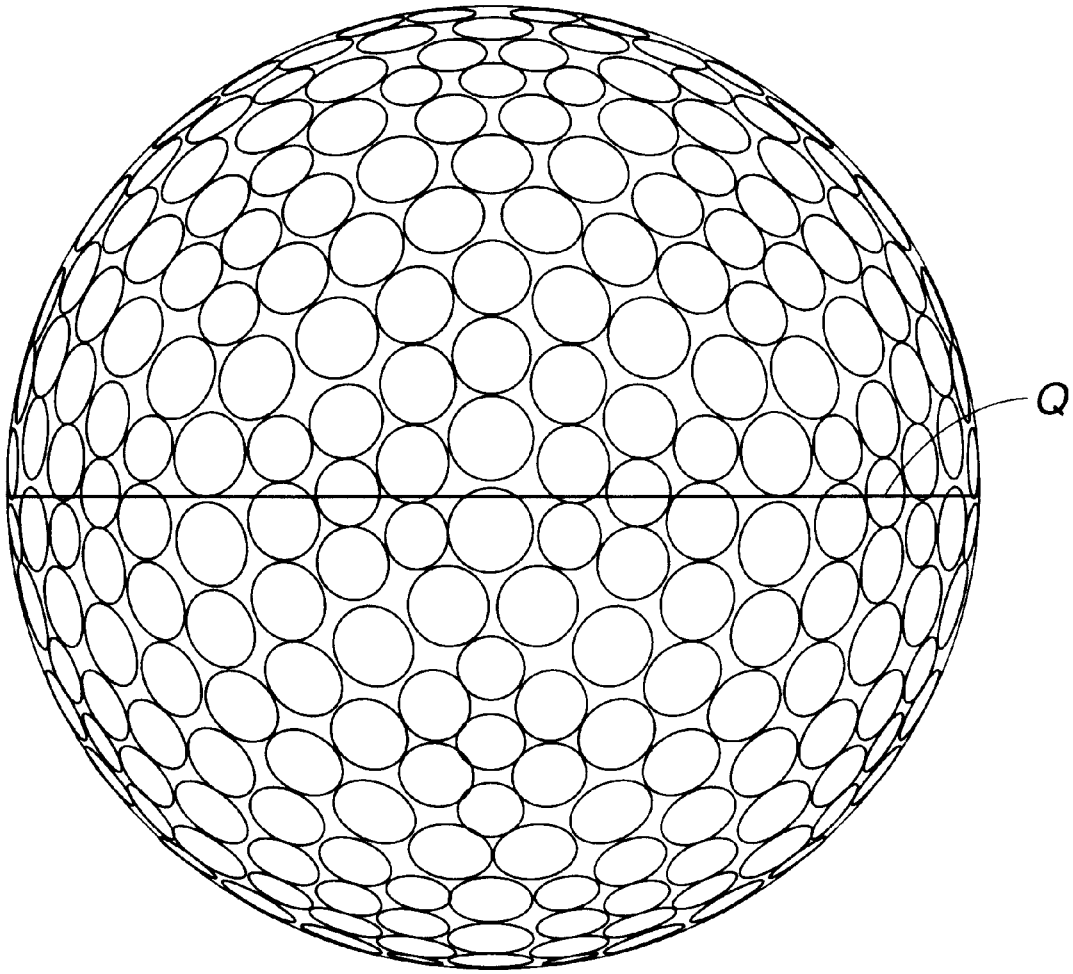

The arrangement patterns of dimples on the balls are as follows. Arrangement A: FIGS. 5 and 6 (regular icosahedral) Arrangement B: FIGS. 7 and 8 (regular octahedral) Arrangement C: FIGS. 9 and 10 (regular icosahedral)

In these figures, P designates a pole and Q an equator.

The detail of the dimple configuration is shown in Table 1. The detail of the dimple arrangement is shown in Tables 2 and 3.

In tests, the golf balls thus obtained were hit with a driver (W#1) at a head speed of 45 m/s, and their spin, initial velocity, lateral bend and travel distance were determined.

The test results are shown in Table 4. In the test, each ball was hit 20 times at random positions on its surface. Maximum and minimum values were reported for the spin and initial velocity, maximum and minimum values were reported for the angle of bend in a lateral direction, and an average was reported for the travel distance.

TABLE 1

| Arrangement A | | | | | | | |
|---|---|---|---|---|---|---|---|
| Dimple type | 1 | 2 | 3 | 4 | 5 | 6 | 7 |
| Number of dimples | 234 | 48 | 12 | 60 | 42 | 24 | 12 |
| Dimple diameter (mm) | 3.30 | 3.80 | 2.740 | 2.360 | 3.840 | 3.780 | 3.320 |
| Dimple cavity depth (mm) | 0.253 | 0.249 | 0.172 | 0.148 | 0.273 | 0.268 | 0.210 |
| Dimple edge angle θ (°) | 13.3 | 12.5 | 9.4 | 9.5 | 12.8 | 13.6 | 13.6 |
| Dimple cavity volume ($mm^3$) | 1.039 | 0.970 | 0.370 | 0.248 | 1.092 | 1.076 | 0.694 |

| Arrangement B | | | | | | |
|---|---|---|---|---|---|---|
| Dimple type | 1 | 2 | 3 | 4 | 5 | 6 |
| Number of dimples | 40 | 184 | 114 | 32 | 16 | 6 |
| Dimple diameter (mm) | 4.100 | 3.910 | 3.330 | 4.080 | 3.880 | 3.050 |
| Dimple cavity depth (min) | 0.275 | 0.258 | 0.200 | 0.284 | 0.268 | 0.190 |
| Dimple edge angle θ(°) | 14.2 | 13.6 | 10.4 | 15.4 | 14.5 | 11.6 |
| Dimple cavity volume ($mm^3$) | 1.391 | 1.181 | 0.669 | 1.466 | 1.251 | 0.534 |

| Arrangement C | | | | |
|---|---|---|---|---|
| Dimple type | 1 | 2 | 3 | 4 |
| Number of dimples | 120 | 132 | 120 | 90 |
| Dimple diameter (mm) | 3.760 | 3.570 | 3.360 | 2.980 |
| Dimple cavity depth (mm) | 0.250 | 0.233 | 0.217 | 0.200 |
| Dimple edge angle θ (°) | 13.3 | 12.5 | 11.8 | 9.5 |
| Dimple cavity volume ($mm^{3)}$ | 1.027 | 0.865 | 0.706 | 0.492 |

Note:
Surface area of ball: 5720 $mm^2$
Area of a ball surface portion delimited by a 20-mm diameter circle: 334 $mm^2$
Area of a ball surface portion delimited by a 18-mm diameter circle: 267 $mm^2$
Volume of ball: 40679 $mm^3$
Volume of a cone bottomed with a 20-mm diameter circle: 2273 $mm^3$
Volume of a cone bottomed with a 18-mm diameter circle: 1898 $mm^3$
All these values correspond to a phantom ball which is free of dimples.

TABLE 2

| Arrangement | A | B | C |
|---|---|---|---|
| Total area of dimples ($mm^2$) | 4427 | 4381 | 4345 |
| Total area of dimples within 20-mm circle, Max ($mm^2$) | 216.5 | 221.8 | 209.8 |
| Total area of dimples within 20-mm circle, Min ($mm^2$) | 206.6 | 204.5 | 202.9 |
| Total area of dimples within 18-mm circle, Max ($mm^2$) | 218.9 | 222.9 | 214.1 |
| Total area of dimples within 18-mm circle, Min ($mm^2$) | 196.5 | 190.9 | 193.5 |
| Dimple surface occupation SR (%) | 77.4 | 76.6 | 76.0 |
| Maximum partial dimple occupation in 20-mm circle, $sr_{max}$ (%) | 81.1 | 83.1 | 78.6 |
| Minimum partial dimple occupation in 20-mm circle, $sr_{min}$ (%) | 73.6 | 71.5 | 72.5 |
| Maximum partial dimple occupation in 18-mm circle, $sr'_{max}$ (%) | 82.0 | 83.5 | 80.2 |
| Minimum partial dimple occupation in 18-mm circle, $sr'_{max}$ (%) | 73.1 | 69.5 | 73.2 |
| Maximum ratio of occupations in 20-mm circle, $sr_{max}$/SR | 1.048 | 1.085 | 1.034 |
| Minimum ratio of occupations in 20-mm circle, $sr_{min}$/SR | 0.951 | 0.933 | 0.954 |
| Maximum ratio of occupations in 18-mm circle, $sr'_{max}$/SR | 1.059 | 1.090 | 1.055 |
| Minimum ratio of occupations in 18-mm circle, $sr'_{max}$/SR | 0.944 | 0.907 | 0.963 |

TABLE 3

| Arrangement | A | B | C |
|---|---|---|---|
| Total dimple cavity volume ($mm^3$) | 388.9 | 419.3 | 366.4 |
| Maximum partial dimple cavity volume in 20-mm circle ($mm^3$) | 23.4 | 25.9 | 22.2 |
| Minimum partial dimple cavity volume in 20-mm circle ($mm^3$) | 22.1 | 23.1 | 20.6 |
| Maximum partial dimple cavity volume in 18-mm circle ($mm^3$) | 18.9 | 20.8 | 18.0 |
| Minimum partial dimple cavity volume in 18-mm circle ($mm^3$) | 17.4 | 17.8 | 16.2 |
| Total dimple cavity volume ratio CV (%) | 0.9586 | 1.031 | 0.901 |

TABLE 3-continued

| Arrangement | A | B | C |
|---|---|---|---|
| Maximum partial dimple cavity volume ratio in 20-mm circle, $cv_{max}$ (%) | 0.985 | 1.091 | 0.936 |
| Minimum partial dimple cavity volume ratio in 20-mm circle, $cv_{min}$ (%) | 0.930 | 0.973 | 0.867 |
| Maximum partial dimple cavity volume ratio in 18-mm circle, $cv'_{max}$ (%) | 0.994 | 1.095 | 0.948 |
| Minimum partial dimple cavity volume ratio in 18-mm circle, $cv'_{min}$ (%) | 0.917 | 0.936 | 0.852 |
| Maximum ratio of dimple cavity volume ratios in 20-mm circle, $cv_{max}/CV$ | 1.030 | 1.058 | 1.039 |
| Minimum ratio of dimple cavity volume ratios in 20-mm circle, $cv_{min}/CV$ | 0.973 | 0.944 | 0.962 |
| Maximum ratio of dimple cavity volume ratios in 18-mm circle, $cv'_{max}/CV$ | 1.040 | 1.062 | 1.052 |
| Minimum ratio of dimple cavity volume ratios in 18-mm circle, $cv'_{min}/CV$ | 0.959 | 0.908 | 0.946 |
| Maximum difference in dimple cavity volume between bisections of 20-mm circle ($mm^3$) | 0.74 | 1.45 | 0.72 |
| Maximum difference in dimple cavity volume between bisections of 18-mm circle ($mm^3$) | 0.85 | 1.56 | 0.92 |

TABLE 4

| | Example | | | Comparative Example | | | | | |
|---|---|---|---|---|---|---|---|---|---|
| | 1 | 2 | 3 | 1 | 2 | 3 | 4 | 5 | 6 |
| Dimple arrangement | A | A | A | B | B | B | A | A | C |
| Cover outer layer Shore D hardness | 54 | 51 | 51 | 54 | 51 | 51 | 49 | 54 | 54 |
| Cover inner layer Shore D hardness | 65 | 65 | 62 | 65 | 65 | 62 | 62 | 50 | 58 |
| Maximum spin (rpm) | 2820 | 2860 | 2880 | 2860 | 2900 | 2910 | 3080 | 3020 | 2950 |
| Minimum spin (rpm) | 2760 | 2810 | 2810 | 2710 | 2790 | 2800 | 3020 | 3010 | 2890 |
| Maximum initial velocity (m/s) | 67.5 | 67.7 | 67.5 | 67.7 | 67.9 | 67.7 | 67.5 | 67.0 | 67.2 |
| Minimum initial velocity (m/s) | 67.2 | 67.5 | 67.3 | 67.0 | 67.2 | 67.2 | 67.2 | 66.9 | 67.1 |
| Most rightward lateral launch angle (°) | 0.3 | 0.3 | 0.2 | 0.5 | 0.6 | 0.5 | 0.2 | 0.1 | 0.2 |
| Most leftward lateral launch angle (°) | 0.2 | 0.2 | 0.1 | 0.6 | 0.6 | 0.6 | 0.2 | 0.2 | 0.2 |
| Average carry (m) | 224 | 226 | 225 | 225 | 226 | 226 | 224 | 224 | 226 |
| Average total distance (m) | 242 | 241 | 239 | 241 | 240 | 240 | 236 | 237 | 237 |

There have been described golf balls having uniform flight performance in that the variation of flight performance with a dimple arrangement is minimized.

Japanese Patent Application No. 2001-189424 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising an elastic core and a resin cover bearing a plurality of dimples and including a cover outer layer having a surface Shore D hardness of at least 50 and a cover inner layer disposed inside the cover outer layer and having a higher surface Shore D hardness than the cover outer layer, wherein the cover defines a ball circumference and an extension thereof, a phantom ball is given on the assumption that the ball is free of dimples, provided that a phantom circumference is radially inwardly spaced 0.08 mm from the ball circumference, and as viewed in a radial cross section of a dimple, a tangent A is drawn to the dimple wall at an intersection of the dimple wall surface with the phantom circumference, the edge of the dimple is given by the intersection between the tangent A and the ball circumference or the extension thereof, and a tangent B is drawn to the ball circumference or the extension thereof at the dimple edge, those dimples in which the angle of inclination of the tangent A relative to the tangent B is at least 13° account for at least 50% of the entire dimples, provided that SR is the ratio of the total area of dimples to the entire surface area of the phantom ball, a dimple-free circle having a diameter of 20 mm is drawn on an arbitrary portion of the ball surface, and sr is the ratio of the total area of those dimples residing in the circle to the area of the circle, a ratio sr/SR has a variation in the range of 0.93 to 1.07 depending on the difference of position on the ball surface, provided that each dimple defines a cavity between the dimple wall surface and the extension of the ball circumference extending over the portion circumscribed by the dimple edge, CV is the ratio of the total cavity volumes of the dimples over the entire ball to the volume of the phantom ball, and cv is the ratio of the total cavity volume of those dimples residing in the 20-mm diameter circle to the volume of a dimple-free cone diverging radially outward from the ball center to the 20-mm diameter circle, a ratio cv/CV has a variation in the range of 0.95 to 1.05 depending on the difference of position on the ball surface.

2. The golf ball of claim 1 wherein when the 20-mm diameter circle drawn on an arbitrary portion of the ball surface is bisected into two semicircles, the difference between the total cavity volume of those dimples residing in one semicircle and the total cavity volume of those dimples residing in the other semicircle is up to 0.88 $mm^3$.

3. The golf ball of claim 1 wherein the cover outer layer has a thickness of 0.8 to 2.0 mm.

4. The golf ball of claim 1 wherein the cover inner layer has a thickness of 1.0 to 2.0 mm.

5. The golf ball of claim 1 wherein the cover outer layer is formed mainly of a thermoplastic or thermosetting polyurethane elastomer.

6. The golf ball of claim 1 wherein the cover inner layer is formed mainly of an ionomer resin.

7. A golf ball comprising an elastic core and a resin cover bearing a plurality of dimples and including a cover outer layer having a surface Shore D hardness of at least 52 and a cover inner layer disposed inside the cover outer layer and having a surface Shore D hardness of at least 62 and higher than the cover outer layer, wherein the cover defines a ball circumference or an extension thereof, a phantom ball is given on the assumption that the ball is free of dimples, provided that a phantom circumference is radially inwardly spaced 0.08 mm from the ball circumference, and as viewed in a radial cross section of a dimple, a tangent A is drawn to the dimple wall at an intersection of the dimple wall surface with the phantom circumference, the edge of the dimple is given by the intersection between the tangent A and the ball circumference or the extension thereof, and a tangent B is drawn to the ball circumference or the extension thereof at the dimple edge, those dimples in which the angle of inclination of the tangent A relative to the tangent B is at least 13° account for at least 50% of the entire dimples, provided that SR is the ratio of the total area of dimples to the entire surface area of the phantom ball, a dimple-free circle having a diameter of 18 mm is drawn on an arbitrary portion of the ball surface, and sr' is the ratio of the total area of those dimples residing in the circle to the area of the circle, a ratio sr'/SR has a variation in the range of 0.93 to 1.07 depending on the difference of position on the ball surface, provided that each dimple defines a cavity between the dimple wall surface and the extension of the ball circumference extending over the portion circumscribed by the dimple edge, CV is the ratio of the total cavity volume of the dimples over the entire ball to the volume of the phantom ball, and cv' is the ratio of the total cavity volume of those dimples residing in the 18-mm diameter circle to the volume of a dimple-free cone diverging radially outward from the ball center to the 18-mm diameter circle, a ratio cv'/CV has a variation in the range of 0.95 to 1.05 depending on the difference of position on the ball surface.

8. The golf ball of claim 7 wherein when the 18-mm diameter circle drawn on an arbitrary portion of the ball surface is bisected into two semicircles, the difference between the total cavity volume of those dimples residing in one semicircle and the total cavity volume of those dimples residing in the other semicircle is up to 0.88 $mm^3$.

* * * * *